United States Patent [19]

Lippincott et al.

[11] Patent Number: 4,820,536

[45] Date of Patent: Apr. 11, 1989

[54] METHOD FOR COOKING MEAT IN A BAG

[75] Inventors: Howard C. Lippincott; Stephen C. Quickert; Larry C. Gundlach, all of Madison, Wis.

[73] Assignee: Oscar Mayer Foods Corporation, Madison, Wis.

[21] Appl. No.: 854,279

[22] Filed: Apr. 21, 1986

[51] Int. Cl.[4] ..... B65B 29/08

[52] U.S. Cl. ..... 426/412; 426/113; 426/124; 426/129; 206/497; 383/111; 53/434; 53/440; 53/449

[58] Field of Search ..... 426/113, 124, 129, 412, 426/126, 127; 53/440, 434, 442

[56] References Cited

U.S. PATENT DOCUMENTS

| | | | |
|---|---|---|---|
| 3,607,312 | 9/1971 | Ready | 426/412 |
| 3,625,348 | 12/1971 | Titchenal et al. | 426/412 |
| 3,681,092 | 8/1972 | Titchenal et al. | 426/412 |
| 3,716,369 | 2/1973 | Perlman | 426/412 |
| 3,759,722 | 9/1973 | Simon | 426/412 |
| 3,769,028 | 10/1973 | Katz et al. | 426/412 |
| 3,864,503 | 2/1975 | Steenolsen | 426/412 |
| 3,900,635 | 8/1975 | Funderburk et al. | 426/412 |
| 3,933,244 | 1/1976 | Hughes et al. | 426/412 |
| 3,961,090 | 6/1976 | Weiner et al. | 426/412 |
| 3,966,980 | 6/1976 | McGuckian | 426/412 |
| 3,983,258 | 9/1976 | Weaver | 426/412 |
| 3,997,677 | 12/1976 | Hirsch et al. | 426/113 |
| 4,218,486 | 8/1980 | Bieler et al. | 426/412 |
| 4,285,980 | 8/1981 | Lewis | 426/412 |
| 4,411,919 | 10/1983 | Thompson | 426/412 |
| 4,448,792 | 5/1984 | Schirmer | 426/412 |
| 4,469,742 | 9/1984 | Oberle et al. | 426/113 |
| 4,606,922 | 8/1986 | Schirmer | 426/129 |

FOREIGN PATENT DOCUMENTS

| | | | |
|---|---|---|---|
| 2803026 | 7/1978 | Fed. Rep. of Germany | 426/412 |
| 5220199 | 2/1977 | Japan | 426/412 |
| 1378140 | 12/1974 | United Kingdom | 426/412 |
| 2135648 | 9/1984 | United Kingdom | 426/106 |

*Primary Examiner*—Steven Weinstein

*Attorney, Agent, or Firm*—J. T. Harcarik; D. J. Donovan

[57] ABSTRACT

A method for cooking meat in a bag wherein a cling film is vacuum sealed and shrunk around the meat, said cling film having a cavity for forming the meat. Next, the cling film is surrounded by an outer film which is vacuum sealed and shrunk around the cling film. The outer film has a softening point above the cooking temperature of the meat. The meat is then heated in the bag to the cooking temperature of the meat. It is found that when this invention is employed that there is minimum purge formed in the bagged cooked product.

1 Claim, No Drawings

METHOD FOR COOKING MEAT IN A BAG

BACKGROUND OF THE INVENTION

1. Field of the Invention

This invention pertains to a method for cooking meat products in a bag, said bag having an inner cling film surrounding the meat and an outer film, said outer film having a softening point above the cooking temperature of the meat. The meat is cooked in the bag with minimum formation of purge.

2. Description of the Prior Art

There have been many descriptions of packaging and cooking meat in bag-like containers.

For example, U.S. Pat. No. 4,287,218 to Rich et al. describes a method wherein whole or pieces of meat are mixed, ground and placed in a mold which is evacuated and sealed. The product is then cooked in the mold under pressure to form a molded meat product. After cooking, however, the cooking package must be removed, moisture drained and the product repackaged for distribution.

Other means of packaging meat are described in U.S. Pat. No. 3,574,682 to Weinke which pertain to producing a fresh looking, raw meat product. The meats are packaged wherein the inner member is an oxygen impermeable member which is first placed around the meat and then sealed with an outer container of oxygen impermeable material enclosing the first container. This invention does not involve cooking the meat and the outer container is removed before sale.

U.S. Pat. No. 3,681,092 to Titchenal et al. pertains to packaging red meat with oxygen-permeable inner films and an oxygen impermeable outer container. The package is heat shrunk around the meat to prevent purging. However, this is not a cook-in bag product.

U.S. Pat. No. 3,653,927 to Howell et al. relates to a meat package including an inner layer of wax impregnated paper towel stock and an outer heat shrinkable bag. The bag is heated to provide a skin-tight cover over the wrapped meat. Again, this is not a cook-in bag product.

U.S. Pat. No. 4,267,960 to Lind et al. relates to a bag for packaging meat having two rectangular outer panels heat sealed to an inner panel useable as a bone guard layer. Both the outer and inner panels can be comprised of ionomer films. The bag is heat sealed around the bone meat, but this patent does not disclose the use of the package as a cook-in bag.

U.S. Pat. No. 4,495,249 to Ohya et al. pertains to heat shrinkable multi-layered laminated films comprised primarily of ethylene vinyl acetate copolymers. Laminated films of ionomer are discussed. This patent, however, does not pertain to cook-in bag products.

Thus, while there have been many patents directed to packaged meat products, it has been desired to produce a packaged meat product wherein the packaged meat product is prepared by cooking the meat product in the bag with minimum formation of purge in the cook bag.

SUMMARY OF THE INVENTION

This invention pertains to a method for cooking meat in a bag. A cling film is heat shrunk and vacuum sealed around a meat product wherein the cling film has a cavity for forming the meat. The cling film is then covered with an outer film which is vacuum sealed and shrunk around the cling film to form a bag wherein the outer film has a softening point above the cooking temperature of the meat. The meat is then heated in the bag to cook the meat. The bag is then cooled.

It has been found when the above invention is employed, the meat is molded and cooked in the bag with minimum formation of purge and may then be distributed and sold in the cook-in bag.

DETAILED DESCRIPTION OF THE INVENTION

The meat product according to the present invention, include meat products made from bovine, porcine, ovine or avian species. Preferably, the meat product is avian and preferably the avian is turkey which maybe a skin or skinless meat product. Furthermore, the meat may be made of whole meat products or may be chunks of meat which are mixed and blended in the manner in the above mentioned U.S. Pat. No. 4,287,218 to Rich et al. herein incorporated by reference.

The meat product is placed into a cling film which suitably is mold formed into a cavity to mold the meat. The cling film is heat shrunk and is vacuum sealed tightly around the meat product.

Cling film materials may be any single layer or multilayer material capable of adhering to the meat product sufficiently to minimize purge of meat juices during cooking of the meat but do not cling sufficiently to cause substantial tearing of the meat skin when the bag is removed. Generally the purge is minimized to less than 5% by weight and preferably less than 3% by weight.

Suitable cling film materials include polyester homopolymers and ionomer films. Examples of ionomer films are metal salt neutralized polymer films obtained from the DuPont Corporation under the trade name Surlyn®. Preferably the Surlyn® is a zinc ion Surlyn®. The cling film as mentioned above may be multi-layered, such as a polyamide layer adhesively bound to a zinc ion Surlyn®layer.

Methods for forming the molded meat product, which include heat shrinking and vacuum sealing the film around the meat product, are described in the above mentioned Rich et al. patent. Suitably the preshrinking occurs at temperatures of 175° F. to 210° F. for about 0.1 to 2 minutes.

It has been found that while the above identified cling films are suitable for minimizing purging of liquids from the meat during the cooking of the meat, the cling films, due to their low melting points, lack structural integrity to withstand the meat cooking temperatures. Thus, a second sealed layer must be vacuum packed and heat shrunk over the cling film material. The outer film must have a softening point above the cooking temperature of the meat. The outer layer may be single layer or multi-layer and typically are constructed of materials such as polyethylene or polypropylene and have a suitable thickness of about 1 mil to about 7 mils.

Next the packaged meat product must be cooked to an internal temperature necessary to cook the particular meat product. For example, beef products must be cooked to an internal temperature of at least 140° F. and non-cured turkey products must be cooked to an internal temperature of at least 160° F. Suitably, the time necessary to cook the products range from about 2.5 hours to about 10 hours. Thus, the outer layer must have a softening point preferably above 140° F. and more preferably above 160° F.

After cooking, the cooked product is cooled preferably to temperatures suitably below 120° F. and preferably to about 40° F. The product may then be placed in cartons for storage at appropriate temperatures prior to shipping for sale.

It has been found that when the bag of the present invention is employed, the meat product is cooked with minimum purge of the meat juices and the cooked meat may be packaged and sold in its cooking bag, thus producing an attractive meat product in an economical manner.

The following examples are presented to further illustrate the invention, but it is to be understood that the invention is not to be limited to the details of the examples.

EXAMPLE 1

Employing vacuum, mold-forming equipment as described in the above mentioned Rich patent, cavities were formed from a cling film materials comprising polyamide adhesively bound to zinc ion Surlyn®. Whole pieces of skinless turkey meat weighing from about 2 to 3 pounds were each placed into the cavities and cling type materials were placed on top of the cavities containing the meat. Cling layers were then vacuumed sealed around the turkey products and heat shrunk at 175° F. to 210° F. for approximately 0.1 to 2 minutes. Next, high temperature tolerant, polypropylene bag, about 4 mils thick, was heat shrunk and sealed under vacuum over the cling layers. The bagged turkey products were then oven roasted to an internal temperature of 160° F.

The heating caused further shrinking of the outer bags over the inner ionomer cling bags. The cooked turkey products were found to contain about 3 to 5 percent by weight purge. The cooked turkey products were then cooled to an internal temperature of 40° F. and packaged for distribution.

EXAMPLE 2

In this example meat products were prepared substantially as in Example 1, except 2 to 3 lbs of ground turkey meat containing salt and phosphate were employed rather than whole meat pieces. The purge was found to be about 0.5% by weight.

We claim:

1. A method for cooking meat in a bag which comprises:

(a) vacuum sealing and shrinking a cling film around the meat wherein the cling film is untreated with ionizing radiation, said untreated cling film having a cavity for forming the meat and being capable of adhering to the meat sufficiently to minimize purge of meat juices during cooking of said meat but not clinging sufficiently to cause substantial tearing of the meat skin when the bag is removed;

(b) then vacuum sealing and shrinking an outer film around the vacuum sealed and shrunk cling film to form a sealed bag, wherein the outer film comprises a layer selected from the group consisting of polyethylene and polypropylene, said outer film having a softening point above the cook temperature of the meat; and (c) heating the meat in the bag including said cling film untreated with ionizing radiation to the cook temperature of the meat wherein the meat in the bag is cooked to an internal temperature above 140° F.

* * * * *